US006464074B1

(12) United States Patent
Dimbath

(10) Patent No.: US 6,464,074 B1
(45) Date of Patent: Oct. 15, 2002

(54) REUSABLE COVER FOR A WIND INSTRUMENT

(76) Inventor: Wolfgang Dimbath, Werner-Von-Siemens-Strasse-14a, D-91052 Erlangen (DE)

( * ) Notice: Subject to any disclaimer, the term of this patent is extended or adjusted under 35 U.S.C. 154(b) by 0 days.

(21) Appl. No.: 09/265,478

(22) Filed: Mar. 10, 1999

(30) Foreign Application Priority Data

Aug. 22, 1998 (DE) ..... 298 15 101 U

(51) Int. Cl.[7] ..... A45C 11/00
(52) U.S. Cl. ..... 206/314; 206/523; 190/903
(58) Field of Search ..... 206/314, 523, 206/315.1; 190/903, 103, 115; 383/66; 135/87, 96

(56) References Cited

U.S. PATENT DOCUMENTS

| | | | | | |
|---|---|---|---|---|---|
| 856,042 | A | * | 6/1907 | Duplessis | 190/103 |
| D101,439 | S | * | 10/1936 | Doppelt | 383/97 |
| 2,481,565 | A | * | 9/1949 | Boretz | 150/903 |
| 3,297,219 | A | * | 1/1967 | Selnes | 206/315.1 |
| 3,708,045 | A | * | 1/1973 | Katz | 190/903 |
| 3,777,862 | A | * | 12/1973 | Zipper | 190/903 |
| 3,840,919 | A | * | 10/1974 | Middleton | 135/96 |
| 3,971,495 | A | * | 7/1976 | Velazquez | 135/96 |
| 4,085,873 | A | * | 4/1978 | Schweitzer | 206/315.1 |
| 4,574,953 | A | * | 3/1986 | Garbuzov | 206/522 |
| 4,706,856 | A | * | 11/1987 | Jacober | 224/151 |
| 4,842,032 | A | * | 6/1989 | Mastronardo | 206/309 |
| 4,846,340 | A | * | 7/1989 | Walther | 206/14 |
| D312,726 | S | * | 12/1990 | Kline | D3/36 |
| 5,007,250 | A | * | 4/1991 | Musielak | 190/903 |
| 5,117,883 | A | * | 6/1992 | Chen | 150/118 |
| 5,219,075 | A | * | 6/1993 | White | 206/314 |
| D339,225 | S | * | 9/1993 | Zel | D3/32 |
| D343,060 | S | * | 1/1994 | Diaz et al. | D3/43 |
| D361,662 | S | * | 8/1995 | King et al. | D3/276 |
| 5,509,589 | A | * | 4/1996 | Kliot | 224/209 |
| 5,651,486 | A | * | 7/1997 | Kliot | 224/653 |
| 5,758,770 | A | * | 6/1998 | Moneta | 206/379 |
| 5,875,890 | A | * | 3/1999 | Di Bernardini | 206/314 |
| 5,881,708 | A | * | 3/1999 | Kliot | 224/653 |
| 5,975,170 | A | * | 11/1999 | Anguiano | 180/159 |

* cited by examiner

*Primary Examiner*—Shian Luong
(74) *Attorney, Agent, or Firm*—Laurence A. Greenberg; Werner H. Stemer; Ralph E. Locher

(57) ABSTRACT

A reusable cover for a wind instrument includes an approximately trapezoidal base surface or a base surface widening approximately in a trumpet shape. The length of the base surface corresponds approximately to the length of the wind instrument. The cover also has a semicircular front surface with a straight bottom edge which at the same time forms a front edge of the trapezoidal or trumpet-shaped base surface. The cover has the advantage of being able to stand when it is loaded with the wind instrument.

20 Claims, 5 Drawing Sheets

REUSABLE COVER FOR A WIND INSTRUMENT

BACKGROUND OF THE INVENTION

Field of the Invention

The invention relates to a reusable cover, in particular a carrying bag, for a wind instrument, in particular a metal wind instrument, such as, for example, a horn, a tuba or a trombone.

Such a cover, e.g. in the form of a carrying bag or a case, serves to easily transport the wind instrument. In addition, it performs a protective function. That is because damage to the instrument must be avoided at all costs. Furthermore, the cover is to be relatively light and easy to handle. In particular, an interior space must be easily accessible in order to be able to put the instrument in and take it out.

It has now been found that conventional covers which are made of a non-metallic material or which are not made of a relatively rigid plastic tend to fall over. There is then the risk of damage to the wind instrument. Furthermore, such covers are relatively heavy, and in the case of rigid plastic there is the risk of splintering under the effect of an impact.

SUMMARY OF THE INVENTION

It is accordingly an object of the invention to provide a reusable cover for a wind instrument, which overcomes the hereinafore-mentioned disadvantages of the heretofore-known devices of this general type, which is stable and which is suitable as a bag for a wind instrument.

With the foregoing and other objects in view there is provided, in accordance with the invention, a reusable cover, in particular a carrying bag, for a wind instrument, in particular a metal wind instrument, comprising a base surface having an approximately trapezoidal or approximately trumpet shape, a front edge and a length corresponding approximately to a length of the wind instrument; and an at least approximately semicircular front surface having a straight bottom edge coinciding with the front edge of the base surface.

In accordance with another feature of the invention, a suitable material for the cover is preferably a flexible textile plastic which is provided with a padding on the inside. This inner padding may also be provided with a lining. Such a material has sufficiently high inherent stability and can effectively protect the wind instrument.

In accordance with a further feature of the invention, there is provided a zip fastener which preferably serves to close the cover. This zip fastener may be disposed in various ways.

In accordance with an added feature of the invention, the zip fastener extends upward approximately centrally over the rear surface and downward approximately centrally over the front surface.

In accordance with an additional feature of the invention, the zip fastener, as viewed from a rear region of the cover, runs along an arcuate curve into a front region while leaving the front surface free, and the arcuate curve lies essentially on a right-hand or left-hand side surface.

In accordance with yet another feature of the invention, the zip fastener preferably starts from an edge of a rear surface. This edge may be a top, side or base edge of the rear surface.

In accordance with yet a further feature of the invention, with regard to stability and accessibility, it is advantageous if the zip fastener starts from the base edge of the rear surface and first of all runs upward on the rear surface.

In accordance with yet an added feature of the invention, the zip fastener extends from the top edge of the rear surface, first of all runs linearly and only then along the arcuate curve.

In accordance with yet an additional feature of the invention, the zip fastener ends at one of the two side edges of the base surface, preferably 5 to 15 cm before the front surface. It is then ensured that the zip fastener does not come into contact with the bell of the wind instrument.

In accordance with another feature of the invention, there is provided a longitudinal axis, and a zip fastener extending around the longitudinal axis.

In accordance with a further feature of the invention, there is provided a top surface having at least one carrying handle.

In accordance with an added feature of the invention, the base surface and the front surface include an angle other than 90°.

In accordance with again another feature of the invention, it has turned out to be advantageous for the production of the cover if the cover is composed of seven different shaped parts, of which one shaped part forms the base surface and another shaped part forms the front surface.

In accordance with again a further feature of the invention, the semicircular front surface, at its highest point, is at a distance from the straight bottom edge which corresponds to at least the diameter of an imaginary full circle placed in the semicircular portion.

In accordance with a concomitant feature of the invention, there is provided a rucksack fitting which is attached on the outside.

Other features which are considered as characteristic for the invention are set forth in the appended claims.

Although the invention is illustrated and described herein as embodied in a reusable cover for a wind instrument, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
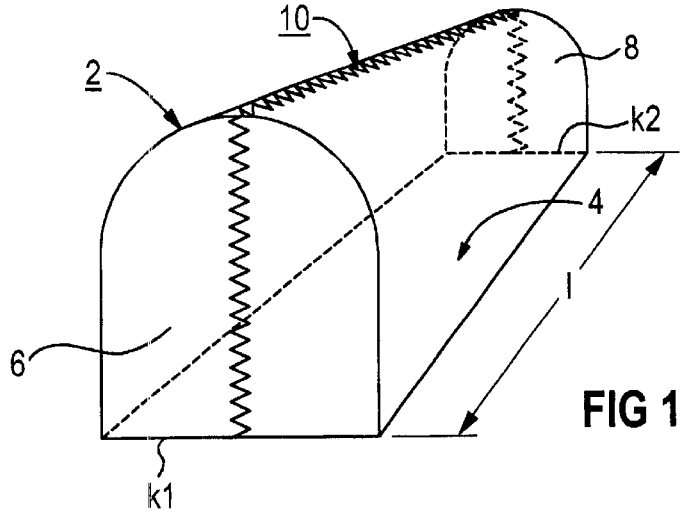
FIG. 1 is a diagrammatic, perspective view of a cover having a largely rectilinear course of a zip fastener being used.

Referring now to the figures of the drawings in detail and first, particularly, to FIG. 1 thereof, there is seen a reusable cover 2 for a metal wind instrument having a roughly trapezoidal base surface 4, the length 1 of which corresponds approximately to the length of a wind instrument to be accommodated therein. The cover 2 is provided with a special semicircular planar front surface 6. This front surface 6 has a straight bottom edge k1, which at the same time is a front edge of the trapezoidal base surface 4. A rear surface 8 likewise has a planar and semicircular structure but is smaller than the front surface 6. A straight bottom edge k2 of the rear surface 8 is fastened to a rear edge of the base surface 4. The rear surface 8 could also be arched outward.

A zip fastener or zipper 10 is provided in order to permit access to an interior space. This zip fastener 10 runs upward from the bottom edge k2 approximately centrally over the rear surface 8, then rectilinearly along a top surface from the rear surface 8 to the front surface 6, and finally downward approximately centrally over the front surface 6. The zip fastener 10 ends at the edge k1. The zip fastener 10 therefore runs in a plane which is approximately a plane of symmetry of the cover 2.

Figure 2:
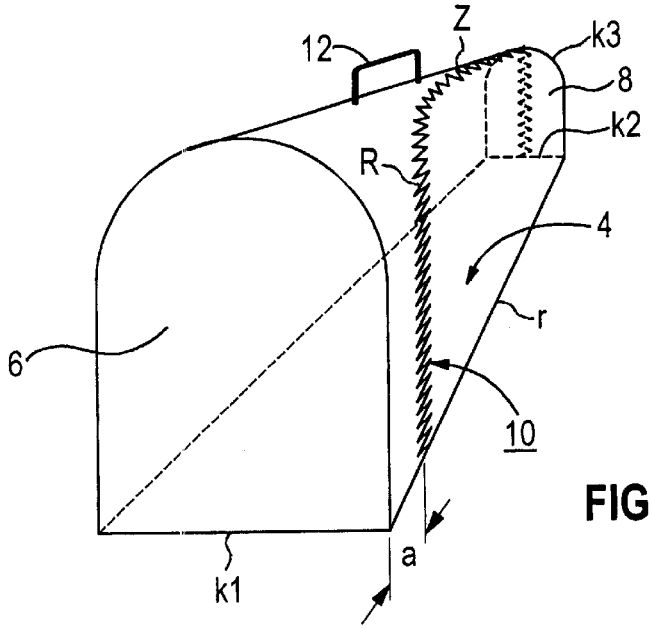
FIG. 2 is a perspective view of a cover having a zip fastener which runs along an arcuate curve on a side surface.

This is not the case with the cover according to FIG. 2. In this case, the zip fastener 10, as viewed from a rear region, runs approximately linearly upward from the bottom edge k2 of the rear surface 8, then bends at a top edge k3 of the rear surface 8, then first of all also runs linearly in this case up to a point Z and finally along an arcuate curve R until it ends at a right-hand side edge r of the base surface 4. An end point is preferably at a distance a of 5 to 15 cm from the front surface 6. This ensures that a bell of a wind instrument, when the latter is packed in the interior space, does not come into contact with the zip fastener 10.

The top surface of the cover 2 is provided with a carrying handle 12. The latter, as shown, may be disposed roughly centrally. A plurality of non-illustrated carrying handles, which if need be are additionally disposed laterally, may also be provided.

Figure 3:
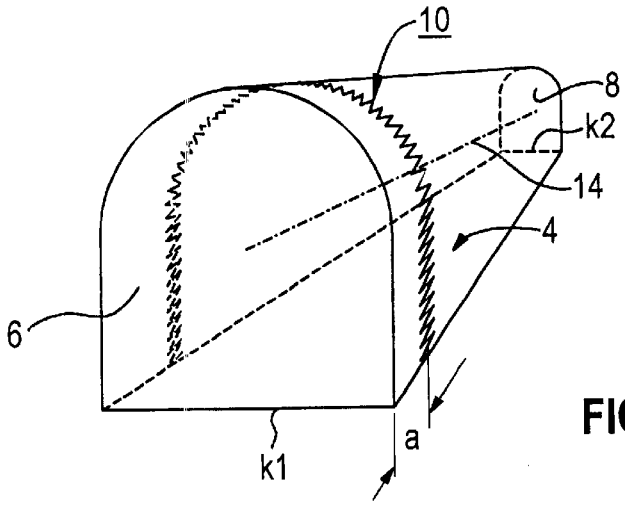
FIG. 3 is a perspective view of a cover having an encircling zip fastener.

FIG. 3 shows an embodiment in which the zip fastener 10 is disposed in a front part and runs around a longitudinal axis 14 of the cover 2. The zip fastener 10 lies essentially in a plane which is disposed perpendicularly to the longitudinal axis 14. The zip fastener 10 is at a distance a of 5 to 15 cm from the front surface 6 in order to again ensure that the bell of the wind instrument does not come into contact with the zip fastener 10.

Figure 4:
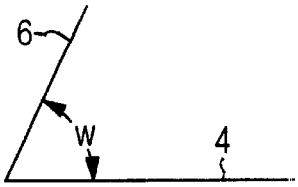
FIGS. 4 to 6 are fragmentary, elevational views of embodiments in which an angle between a base surface and a front surface is respectively less than, equal to and greater than 90°.
Figure 5:
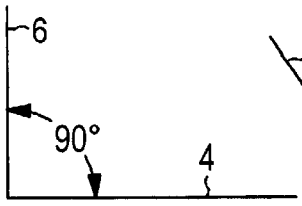
Figure 6:
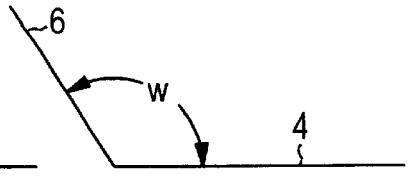

It can be seen from the side views of FIGS. 4 to 6 that the front surface 6 may be inclined relative to the base surface 4. According to FIG. 4 an angle of inclination w is less than 90°; according to FIG. 5 the angle of inclination w is equal to 90°; and according to FIG. 6 the angle of inclination w is greater than 90°. In all three embodiments, excellent stability is ensured as a rule.

Figure 7:
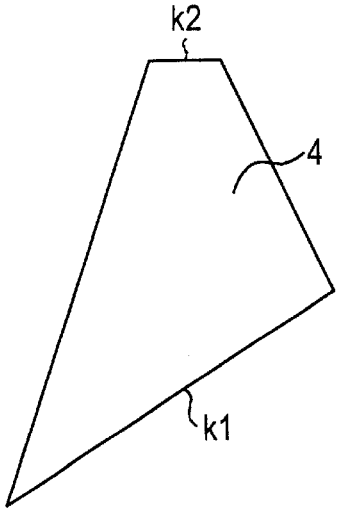
FIGS. 7 to 9 are plan views of embodiments having different geometrical configurations of a trapezoidal base surface.
Figure 8:
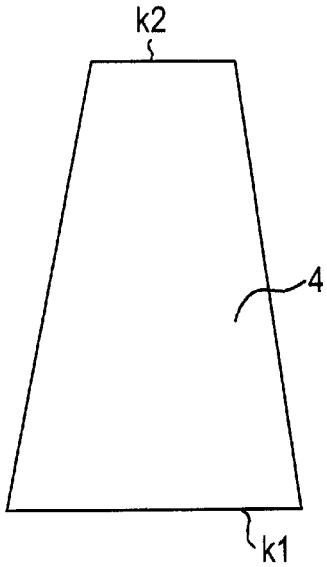
Figure 9:
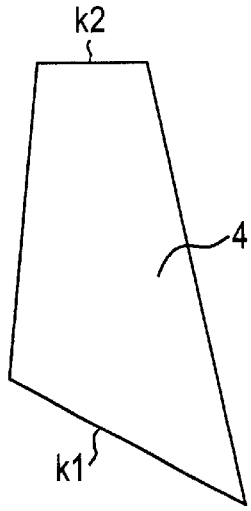

FIGS. 7 to 9 show that the base surface 4 may be constructed to be asymmetrical, symmetrical or again asymmetrical, respectively.

Figure 10:
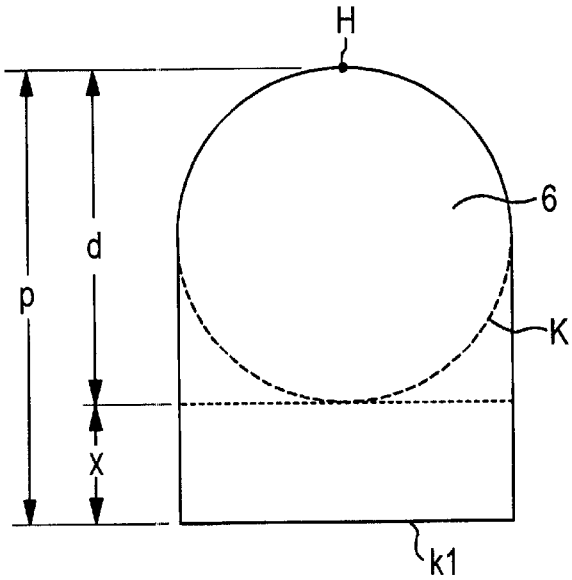
FIG. 10 is an elevational view of a semicircular front surface with different positions x of a bottom straight edge.

FIG. 10 shows a semicircular front surface 6. The highest point of the front surface 6 is designated by reference symbol H, and a distance from the highest point H down to the straight bottom edge k1, which adjoins the base surface 6, is designated by reference symbol p. A full circle K having a diameter d can be inscribed in the semicircular portion, so that a rectangle with a width x is obtained. It becomes clear from FIG. 10 that:

$$p=d+x$$

In other words: the distance p should be equal to or greater than the diameter d of the inscribed full circle K. This condition should always be maintained if possible. The limit case is identified by a broken straight line.

Figure 11:
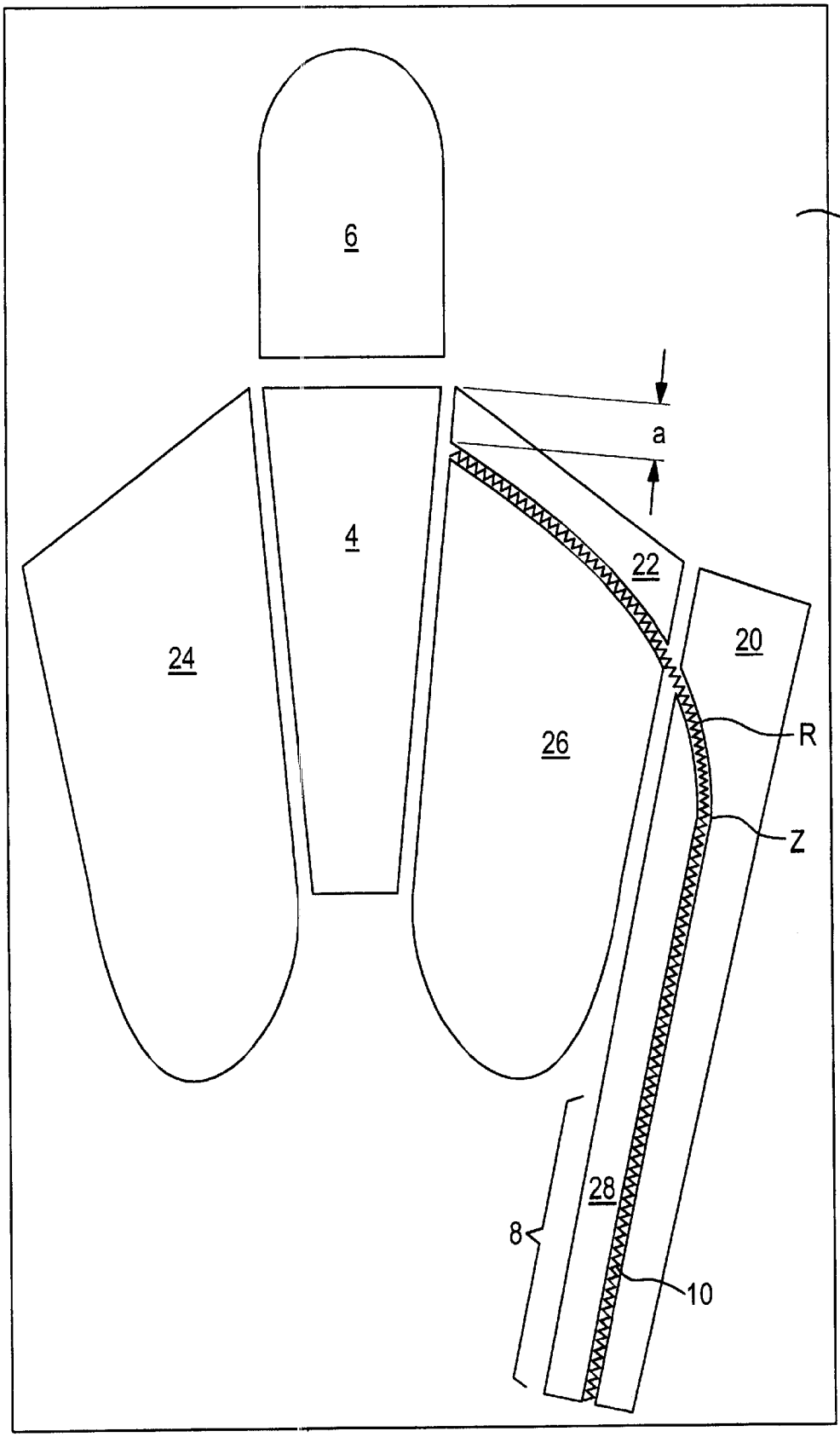
FIG. 11 is a plan view of a cutting sheet or marker having seven different shaped parts or patterns, of which a cover according to FIG. 2 is composed.

FIG. 11 shows a cutting sheet or marker 18 of a flexible textile plastic, from which a total of seven different shaped parts or patterns 4, 6, 20, 22, 24, 26 and 28 can be cut out and then assembled or sewn together in accordance with the embodiment of FIG. 2 having the rear surface 8 arched outward. For the sake of clarity, the individual shaped parts are shown at a distance from one another. When the cover 2 is being made, the zip fastener 10 is inserted between the shaped parts 20, 22 on one hand and the shaped parts 28, 26 on the other hand. A main body, formed of the shaped parts 4, 6, 20, 22 and 24, and a lid, formed of the shaped parts 26 and 28, can be distinguished. Concerning the individual shaped parts, the following may be stated:

The trapezoidal shaped part 4 forms the base surface. Unlike the representation, it may also be constructed to be asymmetrical in accordance with FIGS. 7 and 9. It is dimensioned according to the type of construction of the instrument to be protected.

The semicircular shaped part 6 forms the front surface. It is dimensioned according to FIG. 10.

The shaped part 20 is to be designated as a rib part. In accordance with the course of the zip fastener 10, it is first of all shaped with parallel sides or conically, as viewed from bottom to top, in order to then be enlarged up to a full rib width from a point Z, where the zip fastener 10 leaves the rectilinear course and follows the arcuate line R.

The shaped part 22 is a side part. It fills an intermediate space from a closing edge of the lid part 26 up to the semicircular front surface 6. This side part 22 ensures that the bell of the instrument does not come into contact with the zip fastener 10 at any point. The distance a is responsible therefor.

The shaped part 24 is a left-hand side part. It is rounded off in the rear region, a factor which depends on the shape of the wind instrument to be accommodated.

The shaped part 26 to be attached to a right-hand side is to be designated as a lid part. As can be seen, it is movably fastened with its straight side edge to the trapezoidal base part 4. This lid part 26, together with the side part 22, is complementary to the left-hand side part 24. Both the left-hand side part 24 and the right-hand side part 22, 26 correspond in profiling to a lateral silhouette of the wind instrument to be accommodated.

The shaped part 28 is to be designated as a rib wedge. This rib wedge 28 fills an area between the rib part 20 on one hand and the lid part 26 on the other hand. In this case, the shaped parts 26, 28 together form a lid. This lid 26, 28 lies on that side of the wind instrument on which its mechanism (keys) is disposed. When the zip fastener 10 is opened, this lid 26, 28 can be tilted outward at a tilting edge relative to the base surface 4. It is to be emphasized that the entire rectilinear course of the zip fastener 10 as well as the start of the bending (to the right or left) from the point Z run along the rib wedge 28. The question as to the direction in which the zip fastener 10 is to bend is determined by the position of the mechanism (keys) in the case of instruments which have a lateral mechanism such as, for example, tuba and French horn (in contrast to the jazz trumpet, which has a mechanism at the top).

As a rule, a rucksack fitting is attached to the outside of the cover 2. This rucksack fitting should always lie on the side surface which is opposite the mechanism, thus, in the present case, on the side surface 24. Since the rucksack side is heavily loaded when carrying the cover 2 and thus the wind instrument, it is necessary to relieve the zip fastener 10 of these carrying forces. As mentioned, when the mechanism is laterally positioned, the rucksack fitting therefore always lies on the opposite side in order not to damage the mechanism during carrying. Consequently, the zip fastener in the present case bends toward the side of the mechanism, that is in the direction of the shaped part 26.

It becomes clear from FIG. 11 that the rear surface 8 is formed by the rear or bottom regions of the shaped parts 20, 28. In the exemplary embodiment shown, the zip fastener 10 runs approximately in the center of the rear surface 8.

It may also be noted that the zip fastener 10 could also run along the left-hand rectilinear edge of the shaped part 28.

It is important that the cover 2 does not collapse even when there is no wind instrument in the interior space. A material having a certain inherent stability is therefore selected. In order to obtain this stability, a multilayer structure is preferably provided. A material in the form of a flexible textile plastic is provided as an outer layer. In this case, conventional outer materials for baggage, e.g. nylon, polyester, imitation leather, leather, cordura, vinyl, etc., may be used. This outer material is provided with a padding of foamed material on the inside. This inner padding may be, in particular, polyethylene (PE) or polyurethane (PU). Both materials ensure excellent inherent stability. The density of this material should preferably be within a range of 20 to 30 $kg/m^3$ in the processed state. A soft material may additionally be used as a third layer on the inside in order to protect the wind instrument. This soft material may be velvet, melton, a woven or nonwoven (e.g. knitted) material. Such a lining avoids scratches on the wind instrument, for example. A coating, such as, for example, flocking, is likewise possible for the lining.

Figure 12:
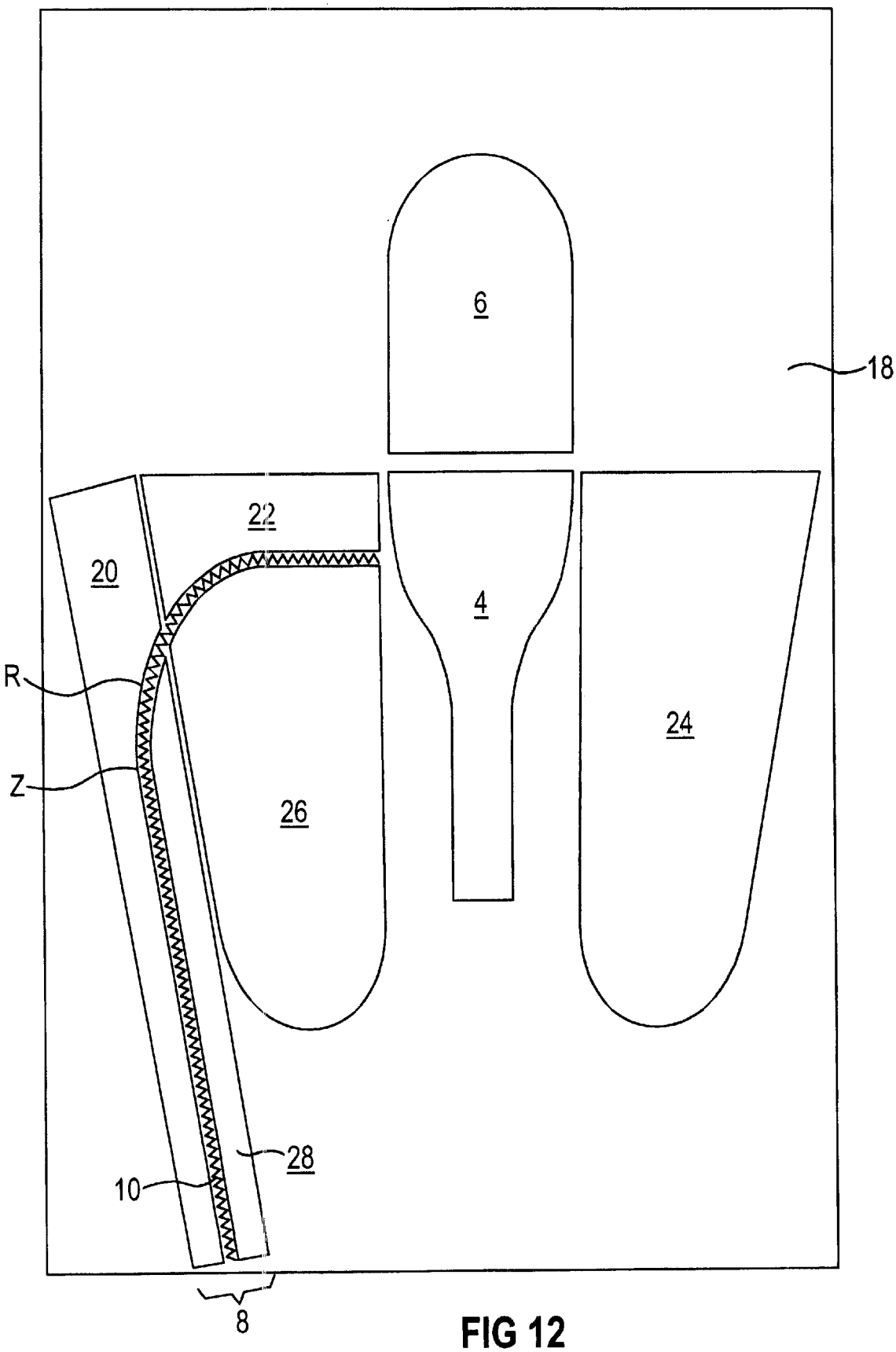
FIG. 12 is a plan view of a cutting sheet or marker in which seven shaped parts or patterns are likewise used, including one for a base surface widening in a trumpet shape and an configuration of a zip fastener on the left-hand side.

FIG. 12 shows an embodiment which largely corresponds to that of FIG. 11. However, two important differences are to be noted: on one hand, the base surface 4 is not trapezoidal but is constructed so as to widen in a trumpet shape, and the zip fastener 10 in this case lies on the left-hand side. However, in this case too, the zip fastener 10 first of all runs in the center of the rear surface 8, then merges linearly into the top part in order to merge at a point Z into an arcuate curve R.

Figure 13:
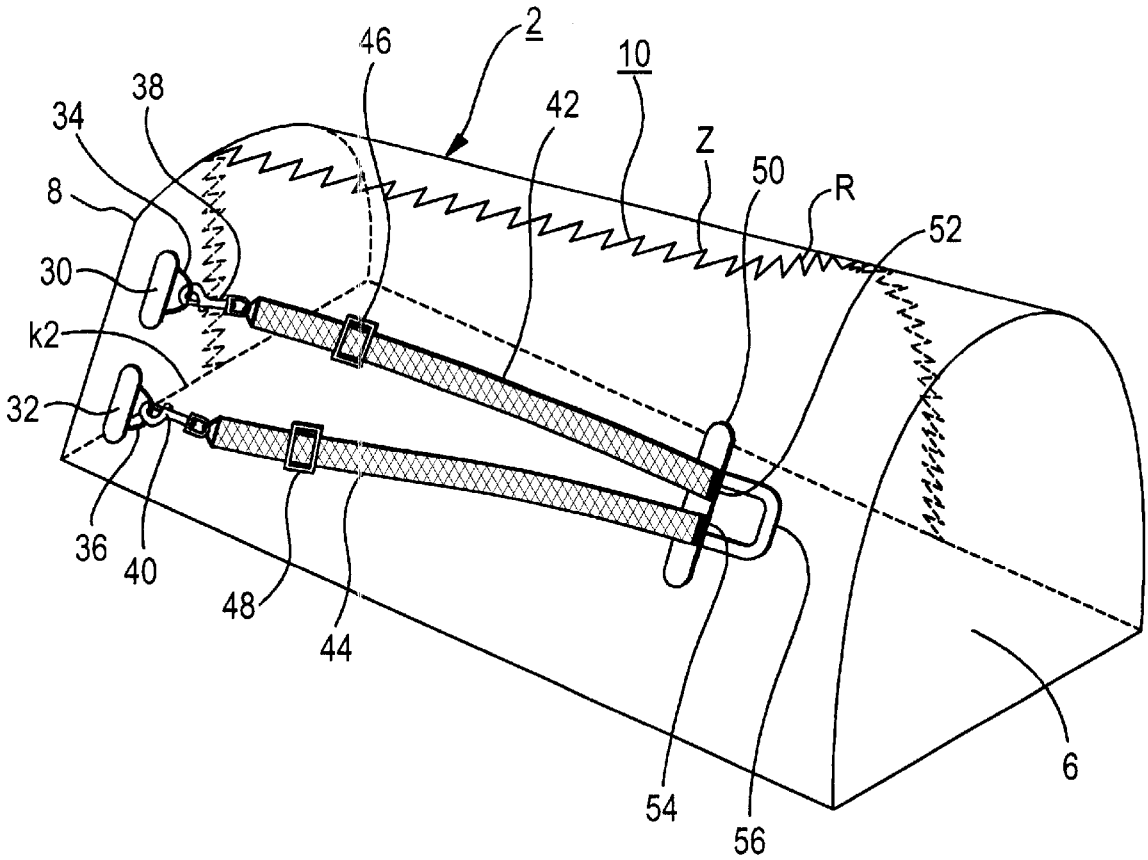
FIG. 13 is a perspective view of a cover having a rucksack fitting.

FIG. 13 shows a cover or carrying bag 2 for a musical instrument, having a rucksack or backpack fitting on the exterior. The carrying bag 2 corresponds, for the most part, to the carrying bag shown in FIG. 2. In a corresponding manner, the front surface is designated with reference numeral 6 and the rear surface with reference numeral 8. In this case as well, the zip fastener or zipper 10 runs upward from the bottom edge k2 over the rear surface 8, then rectilinearly along the top surface to the point Z and then along the arcuate curve R until it ends at the right-hand edge of the base surface 4.

The cover 3 is upright when carried, so that the front surface 6 faces upward and the rear surface 8 faces downward.

A rucksack fitting is essentially formed of two carrying bands or carrying belts 42 and 44, the length of which is adjustable.

The following is noted with regard to fastening the carrying bands 42, 44: Two lower holders 30, 32 are stitched to the bottom part. The lower holders 30, 32 are located approximately at the height of the hip of a person carrying the rucksack. Rings 34, 36 are fastened in the holders 30, 32. Carabiner hooks 38, 40, which are fastened to the bottom end of the carrying bands 42, 44, engage in the rings 34, 36. The carrying bands 42, 44 can thereby be disposed in such a way that they run upward in a wedge-shaped manner, as shown.

Sliders 46, 48 are provided for length adjustment within the carrying bands 42, 44. The bands 42, 44 have upper ends which terminate in fasteners 52, 54 that are stitched to an upper holder 50. The upper holder 50 is located approximately at shoulder height of the person carrying the rucksack.

A handle 56 is fastened to the upper holder 50 to ease handling of the carrying bag 2, in particular to permit carrying or throwing the rucksack over the shoulder.

In summary, with regard to the preferred exemplary embodiments, the following may again be stated: The zip fastener 10 runs from the narrow end (edge k2) of the trapezoidal or trumpet-shaped base surface 4 in the direction of the semicircular front surface 6, but without reaching the latter. This is because the zip fastener 10 describes an arc to the left or right beforehand in order to then meet the base surface 4 again. In the normal case, the arc runs laterally at virtually a right angle at a distance a of 5 to 10 cm to the side of and parallel to the semicircular front surface 6. In this case, the cover 2 is formed of a main body 4, 6, 20, 22, 24 and a movable lid 26, 28. In this case, this lid 26, 28 is considerably smaller than the main body. This is irrespective of whether the zip fastener 10 runs centrally between the shaped parts 20, 28 (symmetrical spacing) or at the continuously straight side of the shaped part 28, as mentioned with reference to FIG. 11. As a rule, a carrying handle will be located on the top surface. If need be, further non-illustrated carrying handles may also be provided in various positions in order to be able, for example, to place the wind instrument on end at the bell. The bell is always located inside the semicircular front surface 6.

The fact that the wind instrument can be inserted into or removed from the cover 2 in a simple manner in both the upright state of the cover 2 and in the horizontal state of the cover 2 (e.g. according to FIGS. 1 to 3), due to the course of the zip fastener 10, must be regarded as an advantage of the cover 2 described with reference to FIGS. 11 and 12. The fact that the carrying bag or cover 2, which is soft per se, does not tip over in the loaded state, may be cited as a further advantage.

I claim:

1. A reusable cover for a wind instrument, comprising:

a) a base surface having a front edge, a rear edge, a quadrilateral shaped region, and a curve shaped region widening from said quadrilateral shaped region to said front edge;

b) a front surface having a substantially semicircular portion and a straight bottom edge coinciding with said front edge of said base surface;

c) an upper portion opposite said base surface; and d) a carrying attachment attached to said upper portion for supporting said base surface such that said base surface faces the ground during transportation.

2. The cover according to claim 1, including a side surface attached to said base surface and to said front surface, and a zip fastener positioned along an arcuate curve extending substantially on said side surface.

3. The cover according to claim 2, including a rear surface having an edge, said zip fastener starting from said edge of said rear surface.

4. The cover according to claim 2, including a rear surface having a base edge, said zip fastener starting from said base edge of said rear surface and extending upward on said rear surface.

5. A reusable cover for a wind instrument, comprising:

a) a substantially flat, widening base surface having a front edge and a rear edge;

b) an upper portion opposite said base surface;

c) a front surface having a substantially semicircular portion and a straight bottom edge coinciding with said front edge of said base surface;

d) a side surface attached to said base surface and to said front surface;

e) a rear surface having an edge and a top edge;

f) a carrying attachment attached to said upper portion for supporting said base surface such that said base surface faces the ground during transportation; and g) a zip fastener starting from said edge of said rear surface and extending from said top edge of said rear surface, initially linearly and then along an arcuate curve extending substantially on said side surface.

6. The cover according to claim 5, wherein said base surface widens in an approximately trapezoidal shape.

7. The cover according to claim 5, wherein at least one of said base surface and said front surface is formed of a flexible textile plastic material having an inner padding.

8. The cover according to claim 5, wherein said base surface has two side edges, and said zip fastener ends at one of said two side edges of said base surface.

9. The cover according to claim 8, wherein said zip fastener ends 5 to 15 cm before said front surface.

10. The cover according to claim 5, including a top surface having at least one carrying handle.

11. The cover according to claim 5, wherein said base surface and said front surface include an angle other than 90°.

12. The cover according to claim 5, including seven different shaped parts, one of said shaped parts forming said base surface and another of said shaped parts forming said front surface.

13. The cover according to claim 5, wherein said front surface has a highest point and encloses an imaginary full circle with a given diameter, said highest point is at a distance from said straight bottom edge, and said distance is at least as large as said given diameter.

14. The cover according to claim 5, including an outside surface, and a rucksack fitting attached on said outside surface.

15. A reusable cover for a wind instrument, comprising:

a) a substantially flat, widening base surface having a front edge and a rear edge;

b) an upper portion opposite said base surface;

c) a front surface having a substantially semicircular portion and a straight bottom edge coinciding with said front edge of said base surface;

d) a side surface attached to said base surface and to said front surface;

e) a rear surface having a base edge coinciding with said rear edge of said base surface and a top edge;

f) a carrying attachment attached to said upper portion for supporting said base surface such that said base surface faces the ground during transportation; and g) a zip fastener starting from said base edge of said rear surface, extending upwards on said rear surface and extending from said top edge of said rear surface, initially linearly and then along an arcuate curve extending substantially on said side surface.

16. The cover according to claim 15, wherein said base surface has two side edges, and said zip fastener ends at one of said two side edges of said base surface.

17. The cover according to claim 16, wherein said zip fastener ends 5 to 15 cm before said front surface.

18. The cover according to claim 15, wherein said zip fastener extends to a side edge of said base surface, and ends at a position from 5 to 15 cm from said front surface.

19. A combination of a metal wind instrument having a length and a reusable cover for the wind instrument, the cover comprising:

a) a substantially flat, widening base surface having a front edge and a rear edge and having a length corresponding approximately to said length of said metal wind instrument;

b) a front surface having a substantially semicircular portion and a straight bottom edge coinciding with said front edge of said base surface;

c) an upper portion opposite said base surface;

d) a side surface attached to said base surface and to said front surface;

e) a rear surface having an edge and a top edge;

f) a carrying attachment attached to said upper portion for supporting said base surface such that said base surface faces the ground during transportation; and g) a zip fastener starting from said edge of said rear surface and extending from said top edge of said rear surface, initially linearly and then along an arcuate curve extending substantially on said side surface.

20. The cover according to claim 5, wherein said zip fastener extends to a side edge of said base surface, and ends at a position from 5 to 15 cm from said front surface.

* * * * *